US005378212A

United States Patent [19]

Pin-Kuo

[11] Patent Number: 5,378,212

[45] Date of Patent: Jan. 3, 1995

[54] ELEVATING STRUCTURE FOR A MOTOR DRIVEN TREADMILL

[76] Inventor: Hai Pin-Kuo, P.O. Box 82-144, Taipei, Taiwan

[21] Appl. No.: 950,025

[22] Filed: Sep. 24, 1992

[51] Int. Cl.[6] ..... A63B 22/02

[52] U.S. Cl. ..... 482/54; 482/51

[58] Field of Search ..... 482/54, 52, 7, 51

[56] References Cited

U.S. PATENT DOCUMENTS 4,502,679 3/1985 De Lorenzo ..... 482/54

4,844,449 7/1989 Trulaske ..... 482/54

*Primary Examiner*—Richard J. Apley

*Assistant Examiner*—Lynne A. Reichard

*Attorney, Agent, or Firm*—Alfred Lei

[57] ABSTRACT

This invention relates to an elevating structure for a motor driven treadmill and in particular to one including a base provided with a front wheel support and a rear wheel support, a frame mounted on the box channel of the front wheel support and provided with an upper plate and a lower plate, a motor installed between the upper plate and the lower plate of the frame and having a splined axle, a driving gear mounted on the upper plate of the frame and engaged with a medium gear which is in turn engaged with the splined axle of the motor, a gear train engaged with the splined axle of the motor and with a variable resistor, and a cover adapted to enclose the upper plate of the frame, whereby the amount of exertion required to maintain pace of an user with the treadmill may be adjusted by inclining the running surface.

1 Claim, 4 Drawing Sheets

ELEVATING STRUCTURE FOR A MOTOR DRIVEN TREADMILL

BACKGROUND OF THE INVENTION

Heretofore, various kinds of exercise treadmill have been developed and sold on the market. However, it has been found that the running surface of the prior art treadmills is kept at a fixed level thereby failing to provide another mode such as a slope for the user.

Therefore, it is an object of the present invention to provide an elevated structure for a motor driven treadmill which may obviate and mitigate the above-mentioned drawbacks.

SUMMARY OF THE INVENTION

This invention relates to an elevating structure for a motor driven treadmill.

It is the primary object of the present invention to provide an elevating structure for a motor driven treadmill which may automatically increase the amount of exertion required to maintain pace with the treadmill by inclining the running surface.

It is still another object of the present invention to provide an elevating structure for a motor driven treadmill which is simple in construction.

It is still another object of the present invention to provide an elevating structure for a motor driven treadmill which is facile to operate.

It is still another object of the present invention to provide an elevating structure for a motor driven treadmill which is economical.

It is a further object of the present invention to provide an elevating structure for a motor driven treadmill which is sturdy in construction.

With the above and other objects in view, the invention consists of the improved elevating structure for a motor driven treadmill, and all its parts and combinations, as set forth in the claim, and all equivalents thereof. In the accompanying drawings illustrating one complete embodiment of the preferred form of the invention, in which the same reference numerals designate the same parts in all of the views.

DETAILED DESCRIPTION OF THE PREFERRED EMBODIMENT

Figure 1:
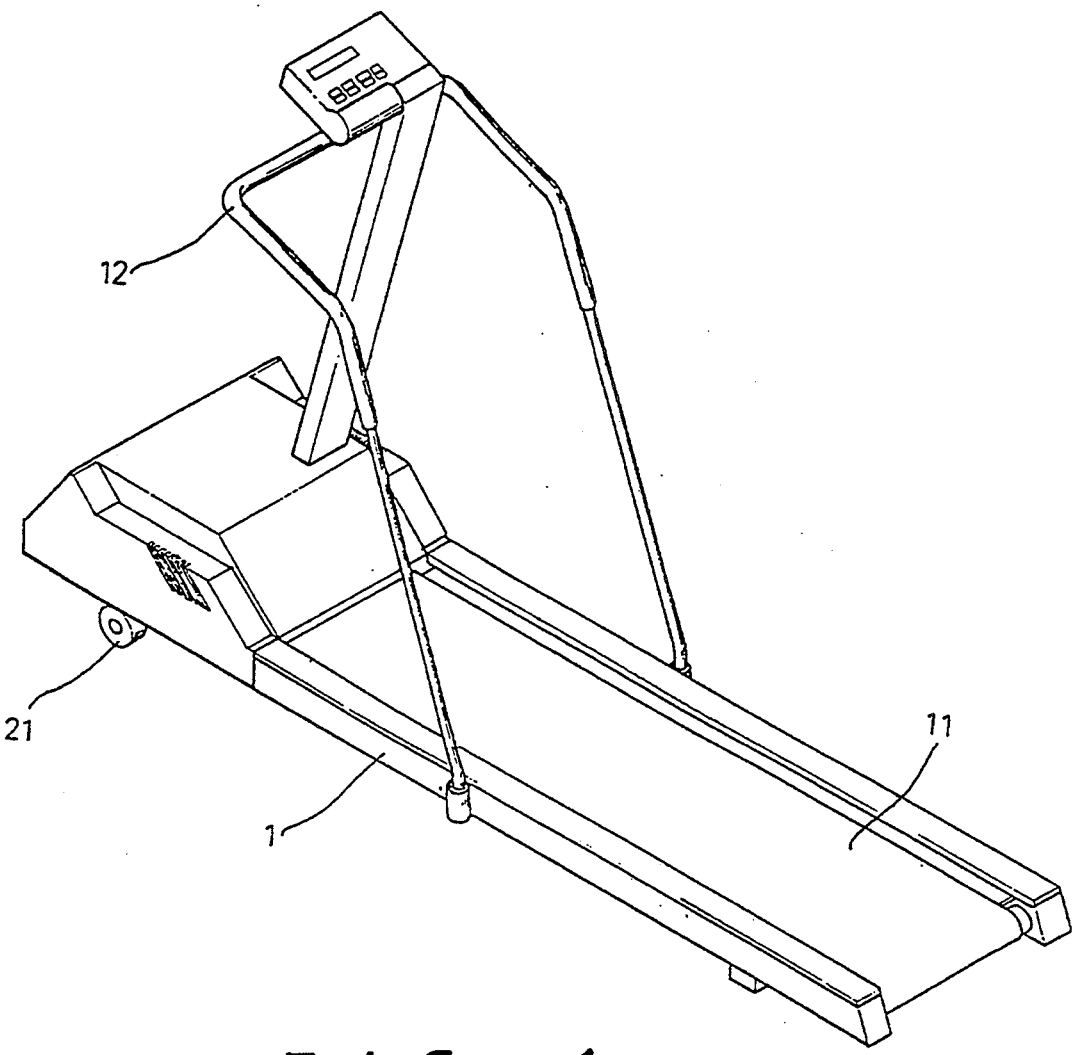
FIG. 1 is a perspective view of a motor driven treadmill.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
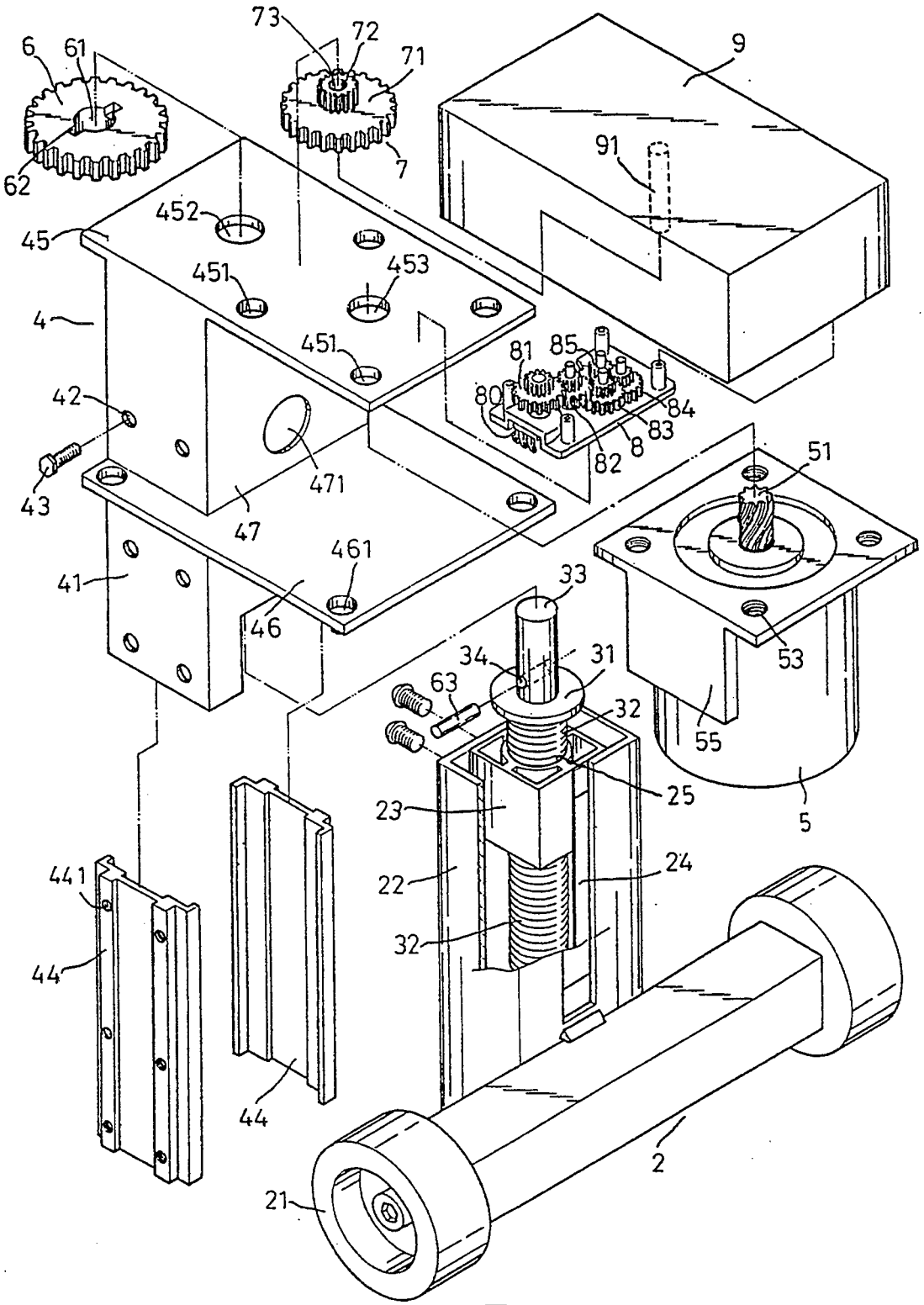
FIG. 2 is an exploded view of an elevating structure for a motor driven treadmill according to the present invention.

With reference to the drawings and in particular to FIG. 1 thereof, the motor driven treadmill is provided with a base 1 on which are mounted an endless belt 11 and a hand rail 12. The base 1 is provided with a front wheel support 2 and a rear wheel support 20 (not shown) of which the former may raise the front side of the base 1 and the latter is fixedly mounted on the bottom of the base 1. Turning to FIG. 2, the front wheel support 2 has a wheel 21 at both ends. On the front wheel support 2 there is a box channel 22 in which there is a block 23 with a threaded hole 25. A shaft 3 with a smooth portion 33 and a threaded portion 32 which are separated by a flange 31. The smooth portion 33 of the shaft 3 has a hole 34. Further, the threaded portion 32 of the shaft 3 is engaged with the block 23. A frame 4 is mounted on the box channel 22 and has a lower portion which is connected with two guiding racks 44 by screws 43 extending through holes 42 of the frame and threaded holes 441 of the guiding racks 44. Further, the frame 4 is provided with an upper plate 45 and a lower plate 46. The upper plate 45 is formed with a plurality of holes 451, a first opening 452 and a second opening 453, while the lower plate 46 has a plurality of holes 461. Between the upper plate 45 and the lower plate 46 there is a vertical portion 47 which is formed with an opening 471. The frame 4 is designed so that when the frame 4 is put onto the box channel 22, the smooth portion 33 of the shaft 3 will extend upwardly through the first opening 452 of the upper plate 45 of the frame 4. A motor 5 is fixedly mounted between the upper plate 45 and the lower plate 46 by screws 52 (not shown) extending through the holes 451 of the upper plate 45 and threaded holes 53 of the mounting plate 55 of the motor 5. Further, the motor 5 has a splined axle 51 extending through the second opening 453 of the upper plate 45. A driving gear 6 is mounted on the upper plate 45 with its center hole 61 sleeved on the smooth portion 33 of the shaft 3. The center hole 61 of the driving gear 6 is formed with two opposite recesses 62 so that when a pin 63 is inserted into the hole 34 of the shaft 3 and engaged with the recesses 62 of the driving gear 6, the driving gear 6 may be moved in unison with the shaft 3. A medium gear 7 composed of a large gear 71 and a small gear 72 is mounted on the upper plate 45, with the large gear 71 meshed with the splined axle 51 of the motor 5 and the small gear 72 with the driving gear 6. A gear 85 is engaged with the spiral axle 51 of the motor 5 and a first compound gear 84. The first compound gear 84 is in turn engaged with a second compound gear 83. Moreover, the second compound gear 83 is engaged with a third compound gear 82 which is in turn engaged with a fourth compound gear 81. In addition, the fourth compound gear 81 is engaged with a variable resistor 80. A cover 9 is put onto the upper plate 45 so that its pin 91 extends through the center hole 73 of the medium gear 7.

When the motor 5 is turned on, the splined axle 51 will be rotated thereby rotating the driving gear 6 and the fourth compound gear 81 via the compound gears 85, 84, 83 and 82. As the driving gear 6 is engaged with the shaft 3, the shaft 3 will be driven to lift the frame 4 upward or to lower the frame 4 downward when the driving gear 6 is rotated. In the meantime, the fourth gear 81 is turned to adjust the variable resistor 80 which will activate an electronic device (not shown) to control the angular distance rotated by the gear 6 hence limiting upward and downward stroke of the shaft 3 and therefore, restricting the distance moved by the frame 4. The electronic device is well known in the art and has no need to be described here in detail.

In addition, a photo-sensitive member 24 is fitted on the block 23 so that when the photo-sensitive member 24 senses light through the opening 471 of the vertical portion 47 of the frame 4, the photo-sensitive member 24 will send out a signal to the electronic device to stop the motor 5 thereby ensuring safety of the user.

Figure 3:
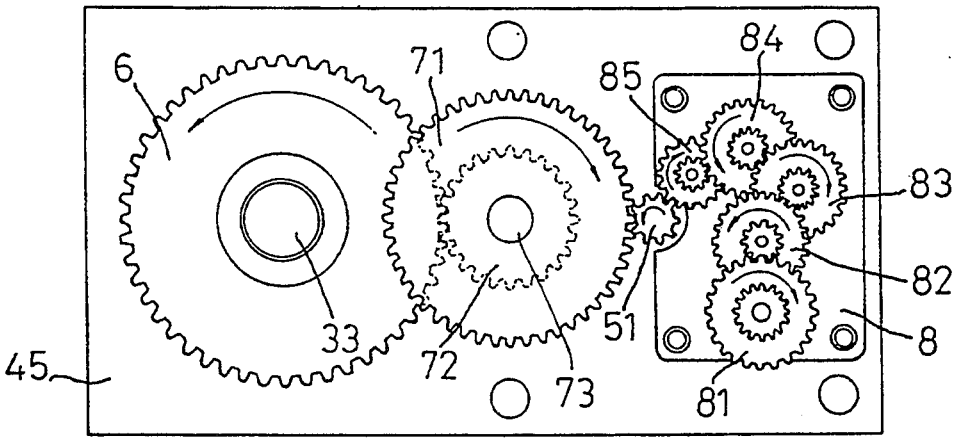
FIG. 3 is a top view of the elevating structure for a motor driven treadmill.
Figure 3A:
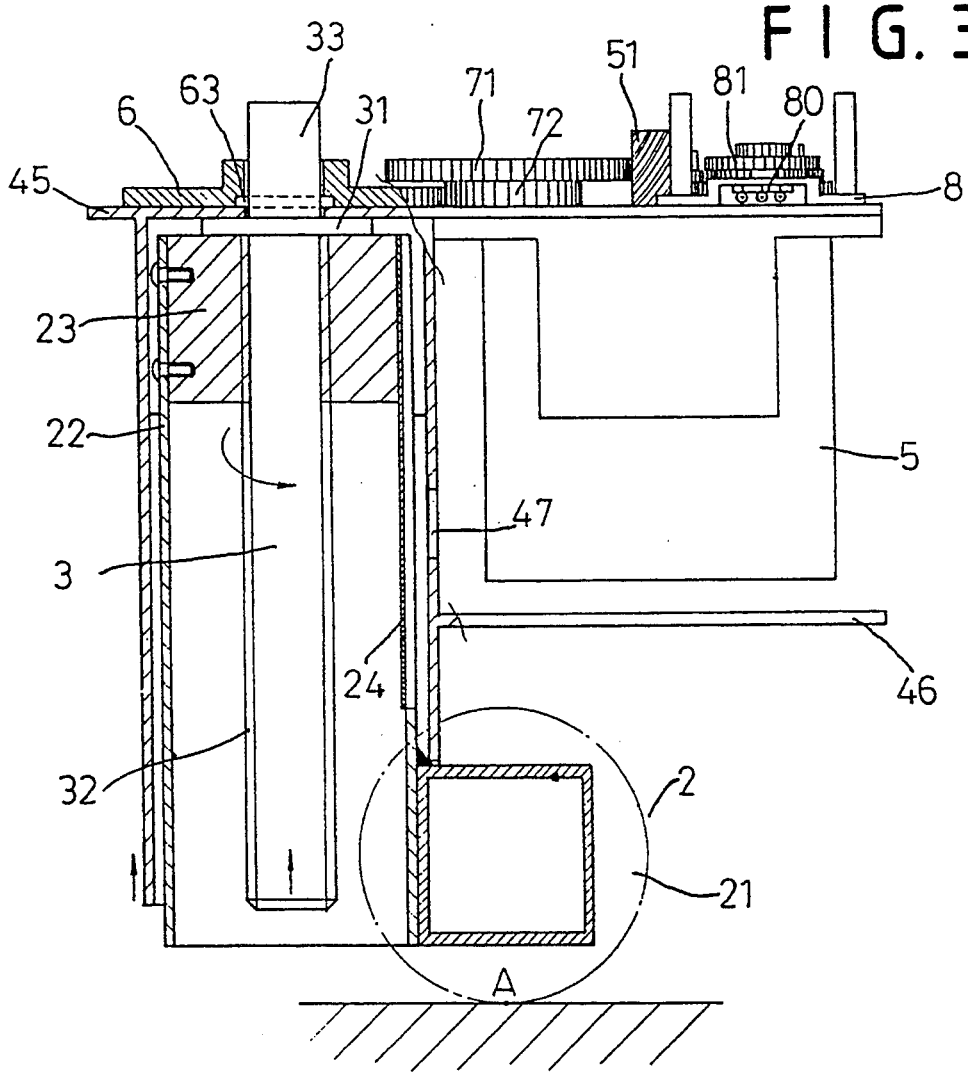
FIG. 3A is a sectional view of the elevating structure for a motor driven treadmill.
Figure 4:
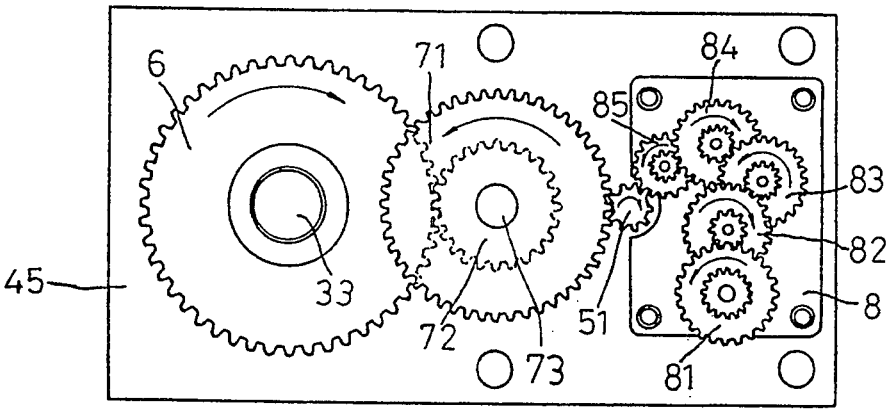
FIGS. 4 and 4A show the working principle of the elevating structure for a motor driven treadmill.
Figure 4A:
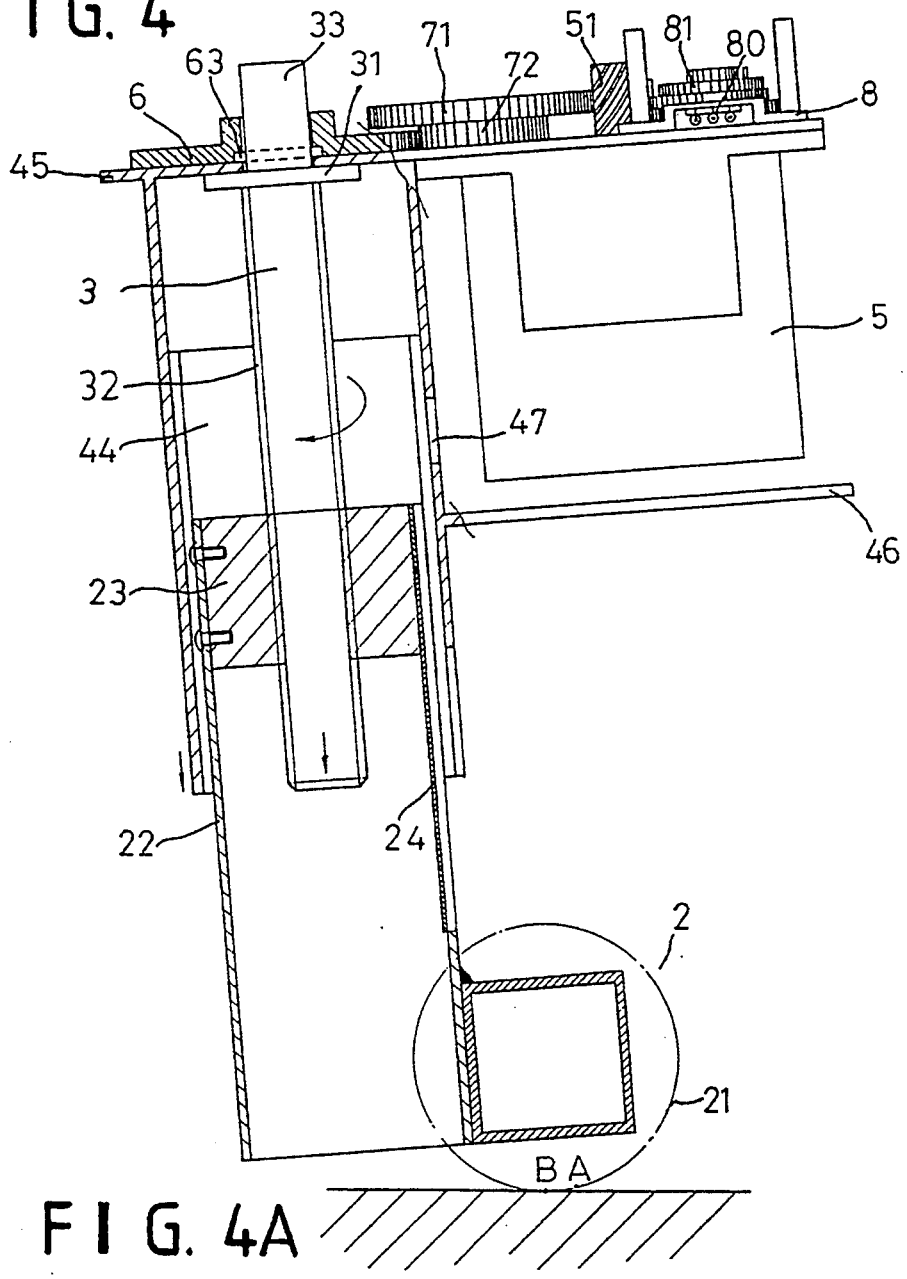

Further, as the frame 4 is elevated by the shaft 3, the wheel 21 will be slightly displaced as shown in points A and B in FIGS. 3A and 4A in order to prevent the structure according to the present invention from being destroyed.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. An elevating structure for a motor-driven treadmill comprising:

a base on which are mounted an endless belt and a hand rail, said base being provided with a front wheel support and a rear wheel support, said front wheel support having a wheel at both ends and a horizontal box channel in which there is a block with a threaded hole;

a shaft having a smooth portion and a threaded portion separated by a flange, the threaded portion of said shaft being engaged with the block of said box channel;

a frame mounted on said box channel, having a lower portion connected with two guiding racks, and provided with an upper plate, a lower plate and a vertical portion between said upper plate and said lower plate, said frame being designed so that when said frame is put onto said box channel, the smooth portion of said shaft will extend upwardly through the first opening of the upper plate of said frame;

a motor installed between the upper plate and the lower plate of said frame and having a splined axle;

a driving gear mounted on the upper plate of said frame and having a center hole sleeved on the smooth portion of said shaft;

a medium gear composed of a large gear and a small gear being mounted on the upper plate of said frame, with the large gear meshed with the splined axle of said motor and the small gear with said driving gear;

a gear train engaged with the splined axle of said motor and with a variable resistor; and a cover adapted to enclose the upper plate of said frame.

* * * * *